United States Patent [19]

Samuels

[11] 4,333,248

[45] Jun. 8, 1982

[54] PROTECTIVE SHOE

[76] Inventor: Samuel Samuels, 1801 J. F. Kennedy Blvd., Apt. 1001, Philadelphia, Pa. 19103

[21] Appl. No.: 171,618

[22] Filed: Jul. 23, 1980

[51] Int. Cl.[3] ..... A43B 13/22; A43B 3/24; A43B 5/00

[52] U.S. Cl. ..... 36/72 R; 36/101; 36/129

[58] Field of Search ..... 36/101, 100, 72 R, 129, 36/126, 127, 128

[56] References Cited

U.S. PATENT DOCUMENTS 3,310,889 3/1967 Samuels ..... 36/77 R 4,051,612 10/1977 Damron ..... 36/72 R 4,103,440 8/1978 Lawrence ..... 36/101

*Primary Examiner*—Patrick D. Lawson

*Attorney, Agent, or Firm*—Paul Maleson

[57] ABSTRACT

An improved protective shoe. The shoe may be an industrial or athletic shoe. A protective cover overlies the toe and instep and is at least partially removeable from the shoe itself. The protective cover has an outer flexible sheet and an inner energy-absorbing layer. A particular improvement lies in providing a flap overlying the shoelaces, with a pair of openable flap closure means on each side of the flap so as to provide an unbroken cushioned surface over the very vulnerable high point of the shoe.

8 Claims, 4 Drawing Figures

PROTECTIVE SHOE

BACKGROUND OF THE INVENTION

1. Field of the Invention

This invention relates to protective shoes. Such shoes may be athletic shoes, such as are used in football, baseball and soccar for example, or industrial shoes, such as are used in high hazard manufacturing areas. The invention relates to additional protective means applied to otherwise conventional shoes. A protective cover is provided. The protective cover may be wholly or partially removable from the shoe. The protective cover is particularly structured so as to maximize convenience and safety.

2. Prior Art

Pertinent examples of prior art include U.S. Pat. Nos. 3,310,889; 3,703,775; and 806,267. While these patents, and other similar ones, are closely allied to the present invention, none of them have all the particular advantages of the present invention. This invention is specifically considered an improvement over U.S. Pat. No. 3,310,889.

SUMMARY OF THE INVENTION

This invention relates to protective shoes for athletic and industrial environments. It particularly involves an improvement in protective covers to add further protection to the toe and instep portions of said shoes. In many activities, it has been well established that there is a high incidence of injuries to the foot, and particularly to the toe and instep portion of the foot. For example, in athletic activities, this is a common type of injury. It is therefore desirable to provide a shoe having an additional protection for these vulnerable areas. While many expedients have been known in the prior art, none of them have reached general or even notable acceptance, and it is believed that such structures may not be in use at all.

In the present invention, a protective cover is provided which has an outer sheath or layer of sheet flexible material, such as leather or plastic of suitable toughness and strength, as is well known. To the inside surface of this sheet is affixed a layer of flexible energy absorbing material, which is preferably a foamed flexible latex. It can be of course any suitable flexible foamed material.

An important advantage of this protective shoe over previously known ones is that a flap at the upper portion of the protective cover is provided. This flap completely overlies the uppermost portion of the shoe, over the laces. This is a particularly vulnerable area, and the structure of the eyelets of the laces etc. provide hard objects that contribute to injury of the foot. Access to the laces is provided without the necessity of removing the entire protective cover, but the closure means for the flap are provided below the topmost portion of a shoe, and away from the laces, so that there is maximum protection where it is greatly needed.

The protective cover may be completely removable by selectively operable attaching means, to provide access to the entire body of the shoe for repair, cleaning etc. Alternatively, the attaching means may be interrupted at the tip, so as to provide a permanent connection of the protective cover to the shoe, but still retaining the ability to swing the protective cover away from contact with most of the shoe, so as to permit servicing.

The flap closure means and the attaching means may be a slide fastener or a zipper. Alternatively, the fastening means known as velcro may be used. The advantage of the velcro is that it eliminates weight and hard objects.

DESCRIPTION OF THE PREFERRED EMBODIMENTS

Figure 1:
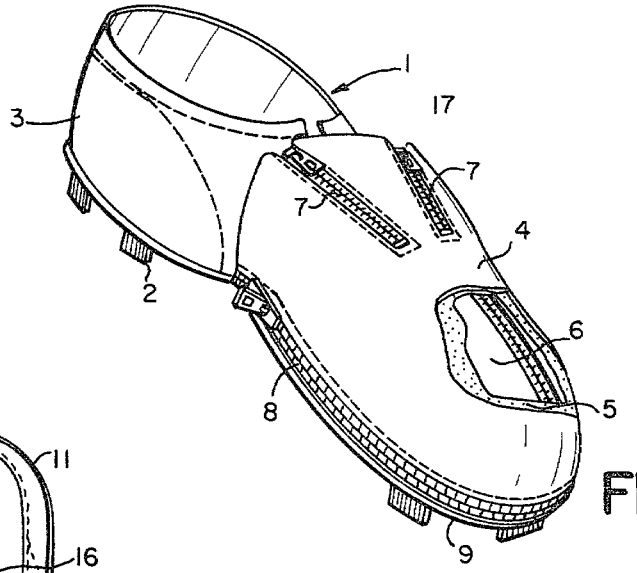
FIG. 1 is a perspective view, partially fragmented, of a protective shoe, where the shoe is an athletic shoe, with the protective cover in place.

FIG. 1 shows a protected shoe, generally designated 1, configured as a sports shoe. The sport may for example be baseball, soccer, or football, all of which involve risk of injury to the toe and instep of the player. The shoe includes cleats 2 conventionally disposed on the bottom of sole 9 and at the bottom of heel 3. A protective cover 4 is provided. The protective cover has an outer surface of a conventional tough, flexible sheet material as is generally used in the manufacture of the uppers of shoes. For example, this may be a leather, or suitable known synthetic plastic material. The protective cover 4 is lined with energy-absorbing foam 5. This foam material 5 is preferably a foamed rubber latex, which may be either natural or synthetic, and which may have a thickness on the order of $\frac{1}{4}''$ to $\frac{3}{8}''$, although the exact thickness is not critical. Foam is adhered to the inner surface of the protective cover 4 by any suitable flexible adhesive.

The entire protective cover, in the embodiment of FIG. 1, is removable from the shoe 1. This apsect is made possible by the provision of a zipper or slide fastener 8. This zipper has one element affixed to and running entirely around the bottom edge of the protective cover 4. The other matching element of zipper 8 is affixed to the outer edge of the sole, at the welt, and runs the appropriate necessary existence around the front of the shoe. This feature makes it possible to remove the protective cover 4 so that the shoe 1 then approximates a conventional sport shoe, differing from such conventional shoe only in the existence of the element of the slide fastener 8 remaining at the welt. The complete removability of the protective cover 4 makes it possible to clean the shoe, remove mud etc. and to polish or repair the shoe.

An important feature of the invention resides in the provision of a flap 17. The flap 17 in the protective cover 4 overlies the normal conventional laces of the shoe. As clearly shown in FIG. 1, the flap is permanently attached to the cover 4 at the bottom edge of the flap. The flap is two-sided, and each of the openings defining the side of flap 17 is provided with a flap closure means 7, in this case, such flap closure means comprising a zipper or slide fastener. As shown, the zipper comprising the flap closure means opens from the bottom.

In use, the protective cover 4 is affixed to the shoe with its zipper or attaching means 8, thus covering the shoe toe 6 and the laces (hidden in FIG. 1), and the flap closure means 7 are both closed, so that the flap 17 snugly lies over the laces. In this use mode, the desired protection for the toe and instep of the player is provided. By providing a flap 17, and displacing the flap closure means off the high point of the shoe, toward the sides, the probability of a blow to the instep injuring the player is further decreased. This is because of the presentation of a smooth flap surface at the point of greatest impact danger ensures a higher probability of having the energy absorbing foam effectively take the blow.

The reason for having a flap 17 at all, rather than a continuous unbroken protective cover 4 is to permit the user to gain access to the laces of his shoe, either for tying or untying.

Figure 2:
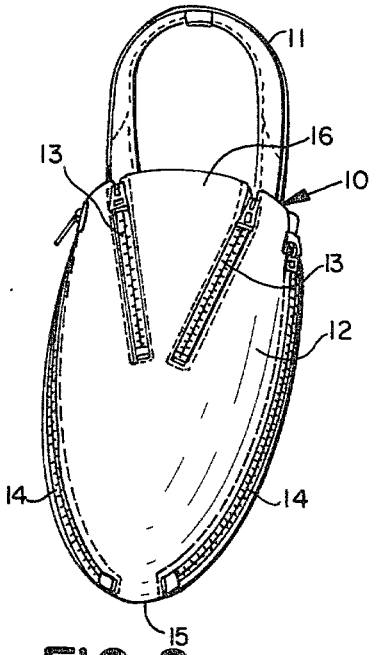
FIG. 2 is a top view of another embodiment of the protective shoe, wherein the attaching means are interrupted at the tip of the toe.

FIG. 2 shows another embodiment of the protected shoe, generally designated 10. FIG. 2 shows the shoe 10 from above, with the heel 11 being visible. The protective cover 12 is provided with a flap 16 and a pair of flap closure means 13. Except as modified below, the protective cover 12, with its flap 16 and flap closure means 13 is the same as has been described in connection with the embodiment of the FIG. 1.

The difference in the embodiment of FIG. 2 lies in the fact that the protective cover 12 is permanently attached to the main body of the shoe. The protective cover 12 and the shoe are provided with elements which together comprise attaching means, which in this case are slide closures or zippers 14. Protective cover 12 is permanently attached to the main body of the shoe by tip 15. Instead of there being a continuous zipper closure around the entire interconnecting edge of the protective cover to the shoe, as in the embodiment of FIG. 1, there are instead a pair of such attaching means or zipper closures 14 which each terminate near the front of the shoe, but leave a portion of the protective cover 12 intact, forming the permantently affixed tip 15.

The embodiment of FIG. 2 has both advantages and disadvantages in comparison to the embodiment of FIG. 1. An advantage of the FIG. 2 embodiment is that the protective cover 12 cannot be lost or misplaced with reference to the shoe. Nevertheless, by opening the zippers 14, it is possible to gain access to the toe and other covered portions of the shoe for cleaning, repairs or other service. A disadvantage of the FIG. 2 embodiment is that the inability to completely remove the protective cover means that the shoe cannot conveniently be used in a mode approaching a conventional shoe; in use, the cover must always be utilized.

Figure 3:
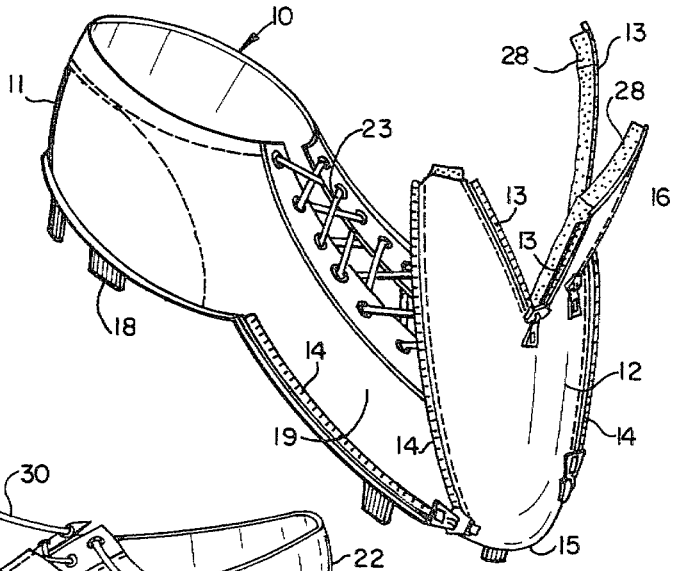
FIG. 3 is another view of the shoe of FIG. 2, wherein the attaching means on the flap closure means are shown in their open condition, with the protective cover partially removed from contact with the shoe itself.

FIG. 3 is a prospective view of the same embodiment as shown in FIG. 2, more clearly showing other structure. The protective shoe 10 has cleats 18. FIG. 3 shows the protective cover 16 with the attaching means 14 opened so that the cover 16 can be raised forwardly and away from the shoe. This open position exposes the shoe top 19. It also more clearly shows the laces 23. The energy absorber 28, which comprises rubber foam as has been described is more clearly shown as it lines both the flap portion and the other portions of the protective cover 12. It is apparent that by opening the flap closure means 13, access can be had to the laces for the purpose, for example, of tightening them, while by opening the attaching means 14, full access is had to the top of the shoe. For example, if it were desired to change the laces, the attaching means 14 would be fully opened.

Figure 4:
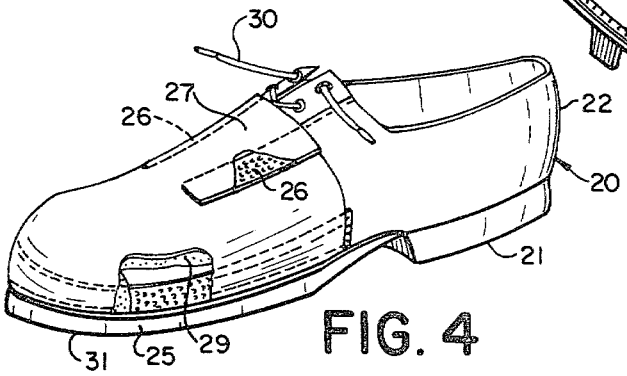
FIG. 4 is a perspective view of another embodiment of a protective shoe, wherein the shoe is an industrial shoe, and the attaching means and flap closure means are velcro.

FIG. 4 shows another embodiment of the invention, in which an industrial shoe, generally designated 20, is shown. This shoe, provided with heel 21 and sole 31, does not have cleats as does a sports shoe. The protective cover 29 is provided with energy absorbing material, in the form of foam attached to its inner surface, as has been described in connection with the other embodiments. The cut-away in the showing of FIG. 4 discloses this structure. In its fully installed mode, the protective cover 29 protects the toe and instep of the industrial shoe in the same manner as has been described in connection with the other embodiments. FIG. 4 shows the back portion or upper heel 22 of the shoe and also shows the laces 30.

In this embodiment, the attaching means 25 which connect the protective cover to the shoe comprise elements of the attaching means, respectively on the inner surface near the lower edge of the protective cover, and on the outer surface of the shoe, toe and instep areas just above the welt. In this embodiment, the attaching means is velcro. Velcro is the name generally used to designate a known type of flexible attachment material. This type of attachment comprises two velvet-type orpile-type fabrics, one of the pair of fabrics being male, and the other being female. The male portion of the velcro comprises a plurality of upstanding open hooks perpendicular to the surface of the material. The female portion of the velcro comprises a plurality of upstanding loops, each loop having a break in its continuity, perpendicular to the surface of the fabric. As is well known, velcro provides a secure but removable fastening means, which is difficult to pull apart by forces parallel to the fabric, but is relatively easy to peel apart.

The flap closure means 26 in the embodiment of FIG. 4, are also made of velcro. As shown, the flap 27 has one element of the velcro on its undersurface, near each of its edges. The other element of the velcro is on the upper surface of the protective cover 29 near the edges of the openings for the flap. As shown also, in this embodiment, the flap 27 has its transverse dimension somewhat extended, in comparison to the other embodiments, so as to provide an overlap on the protective cover, which is necessary for the velcro flap closure means. An advantage of the embodiment of FIG. 4 is that the metallic, or at any rate relatively hard elements of zipper or slide fastening closures are eliminated, and are replaced with closure means or attaching means not having hard aspects. The elimination of such hard aspects means a reduction in the potential for injury, either to the user or others. It also produces a reduction in weight, and an enhanced neatness of appearance.

The provision of this type of protective cover on an industrial shoe is important because in many industries, the worker is exposed to the potential of damaging impacts on the instep and the toe. In some industries, heavy, hard-cased protective shoes are required. While it is apparent that this invention is not a complete substitute for such rigid hard-cased shoes, there are industries and jobs in which the more convenient, though probably somewhat lesser protection, of the present invention is satisfactory, and is more desirable in view of its lightness and convenience.

The scope of this invention is to be determined by the appended claims and is not to be limited by the foregoing drawings and discription.

I claim:

1. In a protective shoe comprising a toe, welt, instep, laces, sole, and heel, the improvement which comprises:

a protective cover, said cover comprising a flexible sheet and a layer of flexible energy absorbing material affixed to the inner surface of said sheet, said protective cover configured to fit over the toe and instep portion of said shoe, said protective cover and said shoe at the welt thereof, each being provided with elements of attaching means, to at least partly remove said protective cover from said shoe, and said protective cover being provided with a central flap portion overlying the laces of said shoe, said flap being provided on each side thereof with one of a pair of selectively operable flap closure means to provide maximum protection to said instep and to provide access to said laces.

2. An improvement in the protective shoe as set forth in claim 1, wherein said attaching means and each of said pair of flap closure means comprises a slide fastener.

3. The improvement to the protective shoe as set forth in claim 1 wherein said attaching means and each of said pair of flap closure means comprises velcro.

4. An improvement in the protective shoe as set forth in claim 1 wherein said attaching means is continuous around the edge of said protective cover attached to said welt of said shoe, to selectively permit said protective cover to be completely removed from said shoe.

5. An improvement to the protective shoe as set forth in claim 1 wherein said attaching means is discontinuous, said attaching means being interrupted at the tip of the toe of said shoe, to permit said protective cover to be partially removed from said shoe and to remain attached to said shoe at said tip.

6. An improvement to the protective shoe as set forth in claim 1 wherein said flap completely covers the laces of said shoe, and each of said pair of flap closure means overlies a portion of said shoe to the side of said laces, and said flap closure means approach each other towards the toe of said shoe.

7. In a protective shoe as set forth in claim 1, wherein said shoe is an athletic shoe.

8. In a protective shoe as set forth in claim 1 wherein said shoe is an industrial shoe.

* * * * *